US009988998B2

(12) United States Patent
Eom et al.

(10) Patent No.: US 9,988,998 B2
(45) Date of Patent: Jun. 5, 2018

(54) ENGINE SYNCHRONIZATION APPARATUS AND CONTROL METHOD THEREOF

(71) Applicant: HYUNDAI MOTOR COMPANY, Seoul (KR)

(72) Inventors: Tae-Kwang Eom, Seoul (KR); Jung-Suk Han, Hwaseong-si (KR); Chang-Hyun Lim, Seoul (KR)

(73) Assignee: Hyundai Motor Company, Seoul (KR)

( * ) Notice: Subject to any disclaimer, the term of this patent is extended or adjusted under 35 U.S.C. 154(b) by 0 days. days.

(21) Appl. No.: 15/288,600

(22) Filed: Oct. 7, 2016

(65) Prior Publication Data

US 2017/0175654 A1 Jun. 22, 2017

(30) Foreign Application Priority Data

Dec. 16, 2015 (KR) ..... 10-2015-0180134

(51) Int. Cl.

*F02P 5/15* (2006.01)
*F02P 7/077* (2006.01)
*F02D 41/00* (2006.01)
*F02D 41/26* (2006.01)

(52) U.S. Cl.

CPC ..... *F02D 41/009* (2013.01); *F02D 41/26* (2013.01); *F02P 5/1506* (2013.01); *F02P 7/0775* (2013.01); *F02D 2041/0092* (2013.01)

(58) Field of Classification Search

CPC ..... F02D 2041/0092; F02P 5/1506; F02P 7/0775
USPC ..... 123/406.62, 406.63
See application file for complete search history.

(56) References Cited

U.S. PATENT DOCUMENTS 5,671,145 A * 9/1997 Krebs ..... F02D 41/009 123/352
5,671,714 A * 9/1997 Fukui ..... F02D 41/009 123/406.62
6,016,789 A * 1/2000 Denz ..... F02D 41/009 123/406.62
6,341,253 B1 * 1/2002 Honda ..... F02D 41/009 123/406.62
6,745,748 B2 * 6/2004 Kobayashi ..... F02D 41/009 123/406.13

(Continued)

FOREIGN PATENT DOCUMENTS

JP 2001-234794 A 8/2001
JP 2002-195092 A 7/2002

(Continued)

*Primary Examiner* — Erick Solis
(74) *Attorney, Agent, or Firm* — McDermott Will & Emery LLP

(57) ABSTRACT

An engine synchronization apparatus includes: a crank shaft position sensor detecting a position of a crank shaft to detect a tooth and a missing tooth; a cam sensor detecting a position of a cam corresponding to an angle of rotation of each of an intake cam and an exhaust cam; and a controller synchronizing the engine to use a tooth detection signal from the crank shaft position sensor and a cam signal from the cam sensor. The controller carries out an engine synchronization by determining the position of the crank shaft and the position of the cam to select one cam between the intake cam and the exhaust cam and to detect the position of a unique part of the cam signal from a voltage level and a level length of the cam signal of the selected cam.

8 Claims, 5 Drawing Sheets

(56) References Cited

U.S. PATENT DOCUMENTS

| | | | | |
|---|---|---|---|---|
| 6,766,242 | B2 * | 7/2004 | Honda | F02D 41/009 123/406.62 |
| 7,013,719 | B2 * | 3/2006 | Adachi | F02D 41/009 73/114.27 |
| 7,305,871 | B2 * | 12/2007 | Arita | F02P 7/061 123/406.11 |
| 7,373,928 | B2 * | 5/2008 | Thomas | F02D 41/062 123/299 |
| 7,628,138 | B2 * | 12/2009 | Ando | F02D 41/009 123/179.3 |

FOREIGN PATENT DOCUMENTS

| | | | |
|---|---|---|---|
| JP | 2003-003901 | A | 1/2003 |
| JP | 2003-049696 | A | 2/2003 |
| JP | 2005-273566 | A | 10/2005 |
| KR | 2003-0029367 | A | 4/2003 |

* cited by examiner

ENGINE SYNCHRONIZATION APPARATUS AND CONTROL METHOD THEREOF

CROSS-REFERENCE(S) TO RELATED APPLICATIONS

This application claims the benefit of priority to Korean Patent Application No. 10-2015-0180134, filed on Dec. 16, 2015 which is incorporated herein by reference in its entirety.

TECHNICAL FIELD

The present disclosure relates to an engine synchronization apparatus and a control method thereof, and particularly, to an engine synchronization apparatus and a control method thereof wherein a fuel injection time and a fuel ignition time of each cylinder in a multiple-cylinder engine in synchronized in such a way to detect a cam signal from a cam sensor and a crank signal from a crank shaft position sensor.

BACKGROUND

In case of a vehicle which equips with an internal combustion engine, the fuel injection time and ignition time are adjusted based on a drive condition, etc. of the vehicle. In case of the multiple-cylinder engine, it needs to accurately synchronize the fuel injection time and ignition time of each cylinder in order to inhibit an engine power degradation and any harmful gas emission which may occur due to an incomplete combustion.

In order to carry out the synchronization of such an engine, it needs to accurately detect the rotation positions of a crank shaft of each cylinder. In a related art, a conventional technology to accurately detect the rotation positions of the crank shaft. According to the conventional technology, a crank shaft position sensor and a cam sensor are employed so as to accurately detect the rotation positions of the crank shaft.

The crank shaft position sensor is configured to detect an angle of rotation and revolution of the crank shaft by detecting the protrusion-shaped teeth formed on a synchronization revolving body of the crank shaft and output them in a pulse type crank signal. The cam sensor is configured to detect the position of a camshaft by recognizing an angle identification protrusion formed at the synchronization revolving body of the camshaft for intake and exhaust, detect a falling edge time and a rising edge time, and output them as pulse type cam signals. The electronic control unit (ECU) is able to recognize the position of the piston of each cylinder with the aid of the crank signal and recognize where the piston of each cylinder is currently positioning, by using the cam signal. The ECU therefore will adjust the injection time and the ignition time of the fuel of each cylinder by using them.

SUMMARY

In case where a position of a crank is detected using a crank shaft position sensor, as illustrated in FIG. 1, the position of the crank may be detected in such a way to detect and judge the number of teeth 220 formed on an outer circumferential surface of a sensor wheel 210 coaxially formed at a crank shaft and missing teeth 230. When it needs to determine the position of the crank after the start of the engine, an engine synchronization control cannot be carried out since the accurate position of the crank cannot be detected until the engine rotates one round after a driver has started the engine. Moreover, the engine synchronization may fail in case where the tooth counting of the crank shaft position sensor goes wrong or the counting is not actually completed.

In order to resolve such a problem, the engine synchronization may be carried out by a quick sync to infer a crank angle in such a way to use a pulse signal from the cam sensor.

The intake and exhaust cams have the same shape, but they are engaged to the engine, with the positions of the first edges of each cam being different. The angle of the cam-based crank may be inferred once any unique part is recognized within the timing of the cam before 360° rotation to the maximum before the missing tooth position is determined using the crank shaft position sensor since the position information on the engagement of the crank shaft and the intake and exhaust cams to the engine is previously known. Here, the cam-based crank angle inferring method is called a quick sync.

In this method, in case where at least one cam signal between the intake cam signal and the exhaust cam signal is used, it may be impossible to determine the position of the crank until the next missing tooth detection time if an error instantly occurs at a corresponding cam signal.

In case of the cam-based quick sync, combination of the position of the missing tooth, the voltage level of the cam signal and the level length is available. If the use method of the combination condition and the validity in term of the combination are not guaranteed, a cam sync-based synchronization may not actually be available.

For example, the engine synchronization may have an error in case where the shape of the cam is recognized by checking any shift of a signal level, without considering the direction of the cam signal level.

The above-mentioned error may occur since the cam shape is recognized in such a way that only the signal level shift is confirmed without considering the direction (H→L, L→H) of the signal level, and the level is confirmed using an inverted value with respect to the previous level value. If a signal level shift exists, it may be appropriate to change to the value (L) which is opposite to the previous level (H). Errors may occur in case of the following conditions.

If the previous level (H) is recognized, but a new signal level generates without detecting an error condition during the signal level shift, the level of the original cam shape may become (H) by simply inverting the level value, or the signal level of the value which the ECU is recognizing may become L. Since the initial original cam shape and the information which the ECU is recognizing are different from each other, an engine synchronization error may occur.

As illustrated in FIG. 5, if a mounting time is set to a tooth falling point before a missing area by a designer's intention in case of the cam edge, an error may occur in the following situation.

The missing tooth position recognition of the crank shaft may be carried out in relation with a tooth period at the front and rear ends of a missing tooth.

The engagement is carried out with the cam edge being included in the missing tooth position in an error range during the assembling procedure, and the crank signal judgment preparation completion is carried out at the tooth falling point before the crank missing tooth area. Here, it may be impossible to recognize the missing tooth point even if the missing tooth position has been passed by the missing tooth position judgment condition. For this reason, the actual cam shape may be an image which includes the missing tooth position, but a result obtained by the quick sync may have an error since the synchronization is carried out with respect to the point where the level length is matched with the level where the missing tooth is included.

The present disclosure is made in an effort to resolve the above-mentioned problems. An object of the present disclosure is to provide an engine synchronization apparatus and a method thereof which are able to quickly carry out an engine synchronization in such a way to infer a crank angle from a pulse shape of a cam signal before the detection of a missing tooth is determined.

In the present disclosure, synchronization can be quickly and accurately carried out during an engine synchronization using a cam signal, in such a way to cross-employ an exhaust cam signal and an intake cam signal.

Other objects and advantages of the present disclosure can be understood by the following description, and become apparent with reference to the embodiments in the present disclosure. Also, it is obvious to those skilled in the art to which the present disclosure pertains that the objects and advantages of the present disclosure can be realized by the means as claimed and combinations thereof.

In accordance with an embodiment in the present disclosure, an engine synchronization apparatus includes: a crank shaft position sensor which is able to detect the position of a crank shaft in such a way to detect a tooth and a missing tooth which are formed at the crank shaft; a cam sensor which is able to detect the position of a cam in such a way to detect an edge corresponding to an angle of rotation of each of an intake cam and an exhaust cam which operate in sync with an engine rotary shaft; and a controller which is able to synchronize the engine in such a way to use a tooth detection signal from the crank shaft position sensor and a cam signal from the cam sensor, wherein the controller carries out an engine synchronization by determining the position of the crank shaft and the position of the cam in such a way to select one earn between the intake cam and the exhaust cam when a detection state of the missing tooth is not determined from the crank shaft position sensor and detect the position of a unique part of the cam signal shape from a voltage level and/or level length of the cam signal of the selected cam.

The engine synchronization is carried out by determining the position of the crank shaft and the position of the cam in such a way to compare a result of the measurement of the voltage level and the level length of the cam signal to a previously stored characteristic value of the cam.

The controller carries out the engine synchronization based on the cam signal of the cam wherein the position of the unique part of the earn signal shape between the intake cam and the exhaust cam has been first determined.

The controller carries out the engine synchronization by using the position information of a corresponding missing tooth in case where the detection of the missing tooth has been determined by the crank shaft position sensor.

The controller determines whether or not the voltage level value has been detected valid, in such a way to judge whether the voltage level of the cam signal has been changed valid to the next level.

In case where the position of the unique part of the cam signal cannot be determined using only the voltage level and the level length which are measured by the cam sensor, the position of the unique part of the cam signal can be determined using a sequential relationship between the previously measured voltage level and level length and the currently measured voltage level and level length.

In accordance with another embodiment in the present disclosure, an engine synchronization method, wherein an engine synchronization is carried out using a crank shaft position sensor configured to detect the position of a crank shaft by detecting a tooth and a missing tooth which are installed at the crank shaft and a cam sensor configured to detect the position of a cam by detecting an edge corresponding to an angle of rotation of each of an intake cam and an exhaust cam which operate in sync with an engine rotary shaft, includes: receiving a cam signal from the earn sensor of each of the intake cam and the exhaust cam; judging whether or not a missing tooth of the crank shaft has been detected by the crank shaft position sensor; determining a cam position in such a way that the information on a voltage level and/or a level length of the detected cam signal to a previously stored position information of a unique part of the cam signal if the detection of the missing tooth of the crank shaft is not determined; and synchronizing the engine using the determined cam position information.

The engine is synchronized based on a cam signal of the cam wherein the position of the unique part of the cam signal has been first determined, among the cam signals received from the intake cam and the exhaust cam.

The position information of a corresponding missing tooth is used in case where the detection of the missing tooth has been determined by the crank shaft position sensor.

According to the present disclosure, an engine start operation can be enhanced while preventing a harmful gas generation which might occur due to an incomplete combustion and an engine power degradation since an engine synchronization can be quickly performed in such a way that the engine synchronization is carried out using a cam wherein the position of a unique part of a cam signal related with a cam shape is determined.

Moreover, according to the present disclosure, an engine start operation can be improved since a crank position of each cylinder can be quickly and accurately determined using another cam signal even if an output signal between an exhaust cam signal and an intake cam signal has an error.

DETAILED DESCRIPTION OF SPECIFIC EMBODIMENTS

Figure 1:
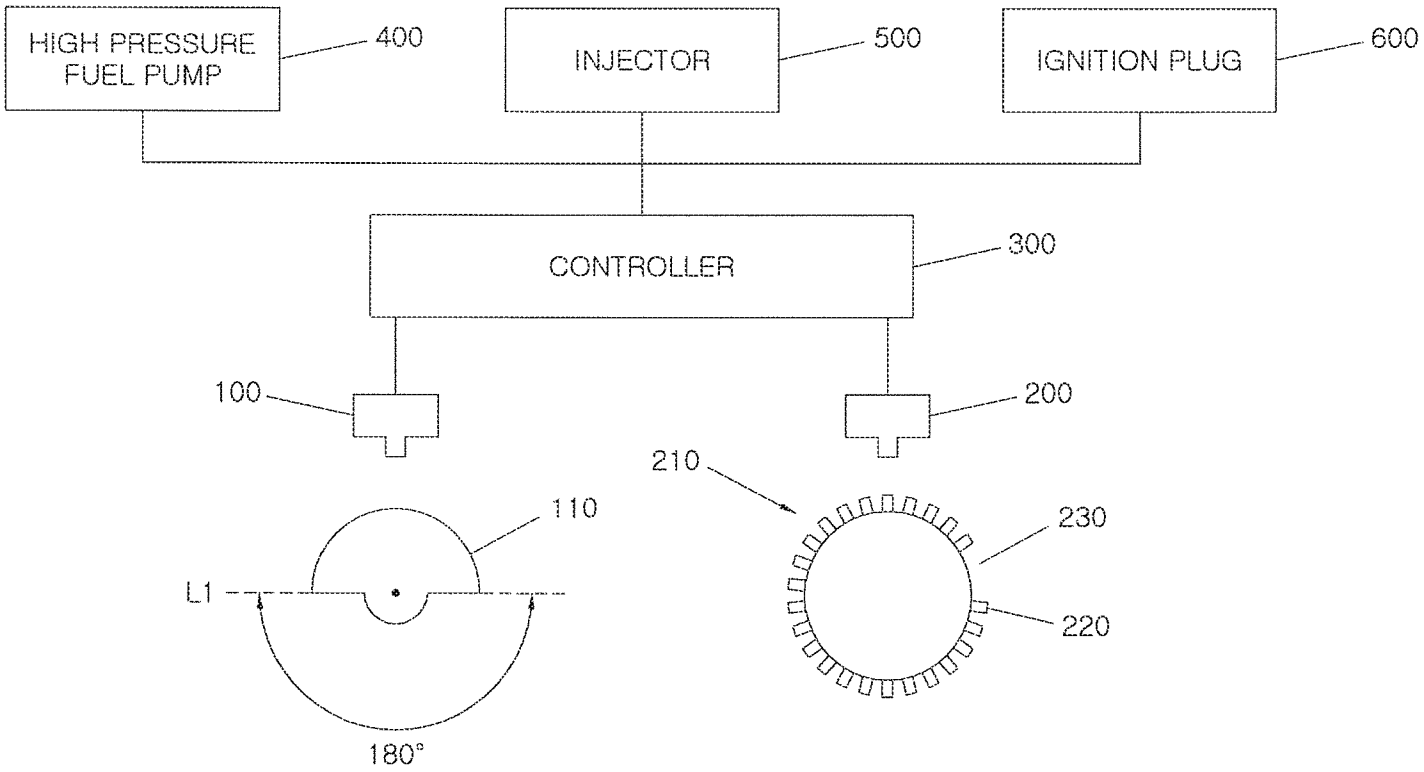
FIG. 1 is a view illustrating a configuration of an engine synchronization apparatus according to the present disclosure.

The terms and words used in the specification and claims should not be construed as their ordinary or dictionary sense. On the basis of the principle that the inventor can define the appropriate concept of a term in order to describe his/her own invention in the best way, it should be construed as meaning and concepts for complying with the technical idea of the present disclosure. Accordingly, the embodiments described in the present specification and the construction shown in the drawings are nothing but one embodiment in the present disclosure, and it does not cover all the technical ideas of the invention. Thus, it should be understood that various changes and modifications may be made at the time of filing the present application. In addition, detailed descriptions of functions and constructions well known in the art may be omitted to avoid unnecessarily obscuring the gist of the present disclosure. Exemplary embodiments of the present invention will be described below in more detail with reference to the accompanying drawings.

The embodiments in the present disclosure will be described in detail with reference to the accompanying drawings.

FIG. 1 is a view illustrating a configuration of an engine synchronization apparatus according to the present disclosure.

As illustrated in FIG. 1, the engine synchronization apparatus according to the present invention may include, but is not limited to, a cam sensor 100, a crank shaft position sensor 200, and a controller 300.

The cam sensor 100 is configured to detect an edge of a cam during the rotation of a camshaft of each of an intake cam and an exhaust cam and output the detected edge to the controller 300 in the form of a pulse type cam signal the voltage phase of which is inverted between the high level (H) and the low level (L). For example, when a cam 110 positions higher than a line (L1) indicated by the dotted line, the output of the cam sensor 100 is a high level (H), and when the cam 110 positions lower than the line (L1), the output of the cam sensor 100 is a low level (L). Here, the cam 110 is provided to open and close the intake valve and the exhaust valve disposed in a combustion chamber, and the camshaft rotates in sync with the crank shaft.

The crank shaft position sensor 200 may be disposed near a sensor wheel 210 provided coaxial with the crank shaft. The sensor wheel 210 may include a plurality of teeth 220 along an outer circumference thereof. The crank shaft position sensor 200 is able to detect protrusion-shaped teeth, detect the angle of rotation and revolution of the crank shaft, and output a result thereof to the controller 300 in the form of a pulse type crank signal. Here, teeth are not formed at the whole circumferential direction portions of the sensor wheel 210, namely, the teeth are formed partially missed. The crank shaft position sensor 200 will recognize the above partially missed tooth portions as a missing tooth 230.

The controller 300 will receive a cam signal and a crank signal from the cam sensor 100 and the crank shaft position sensor 200 and determine the crank position and the cam position using a received result. The controller 300 will control a high pressure fuel pump 400, an injector 500 and an ignition plug 600 using the determined crank position and cam position information, thus carrying out a control to synchronize the fuel injection time and the ignition time of each cylinder of the engine.

More specifically, the controller 300 will compare the information on the level, the level length and the presence of the missing tooth within the level length section to the information on a previously stored cam characteristic information and judge an innate unique part of the cam signal shape, during which when not using the information on the inclusion of the missing tooth based on a missing tooth area non-determination of the crank shaft, the position of the unique part can be recognized using the information on the level and the level length. If the above-mentioned recognition is not available, the engine synchronization can be carried out in such a way to determine the position of the unique part with the aid of a combination of the accumulated cam signal shapes.

Figure 3:
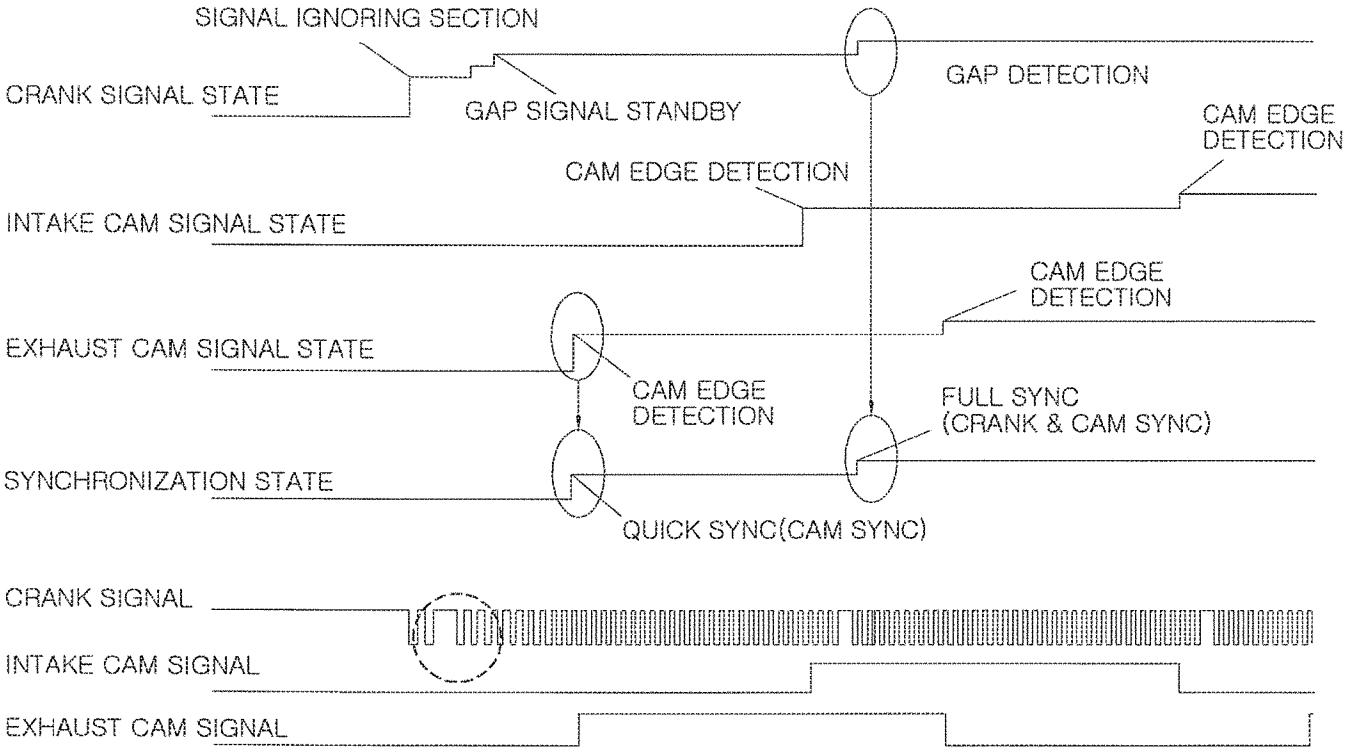
FIG. 3 is a view illustrating a cam signal characteristic of each of an intake cam and an exhaust cam which are formed in a half-moon type according to the present disclosure.

The cam is able to transmit an innate type signal based on the shapes and kinds thereof. FIG. 3 illustrates a cam signal which corresponds to one of the above various types.

Since the cam 110 may rotate at a constant speed over 360°, the signal outputted from the cam sensor 100 may be divided into a constant low level (L) time and a high level (H) time. As described above, the camshaft is able to rotate in sync with the crank shaft. When the crank shaft rotate two rounds, the camshaft will rotate one round. As illustrated in FIG. 3, it therefore is possible to set in order for the missing teeth of the crank signals to be detected at a predetermined time between the low level time and the high level time of the cam signal.

Figure 4:
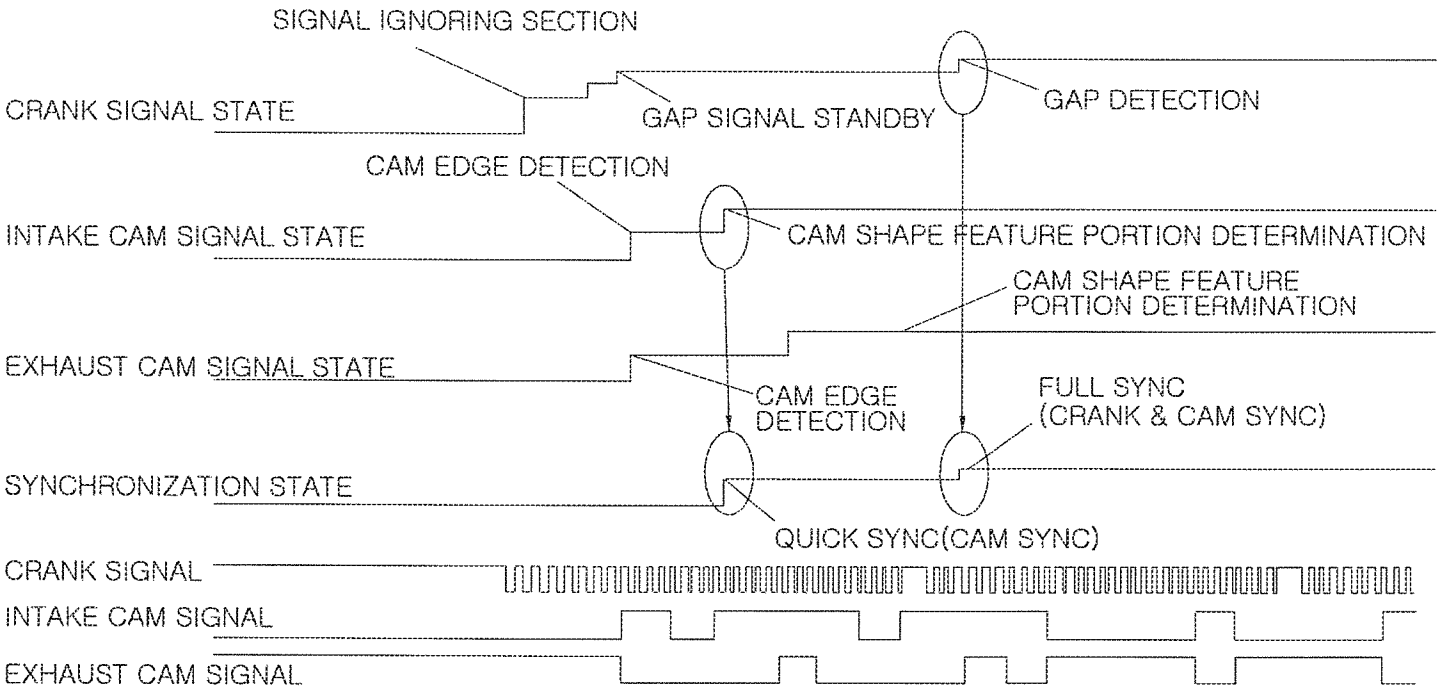
FIG. 4 is a view illustrating a cam signal characteristic of each of an intake cam and an exhaust cam which are formed in a 4-flank type according to the present disclosure.

Since the information on the level of the cam signal at the time when the level distribution and the level length of the cam signal as illustrated in FIG. 3 and FIG. 4 and the missing tooth of the crank signal are detected may have innate values, which are different with respect to the kinds and shapes of the cam, when the crank shaft is at a predetermined rotation position, the crank position at a corresponding time can be determined in such a way to compare, to a previously stored characteristic value, the information on the level distribution and the level length of the measured cam signal and the level of the cam signal at a time where the missing tooth of the crank signal is detected.

The controller 300 of the engine synchronization apparatus according to the present disclosure is able to receive a cam signal from each of the intake cam and the exhaust cam, select an appropriate cam signal between them and synchronize the engine based on the information on a corresponding cam signal.

Figure 2:
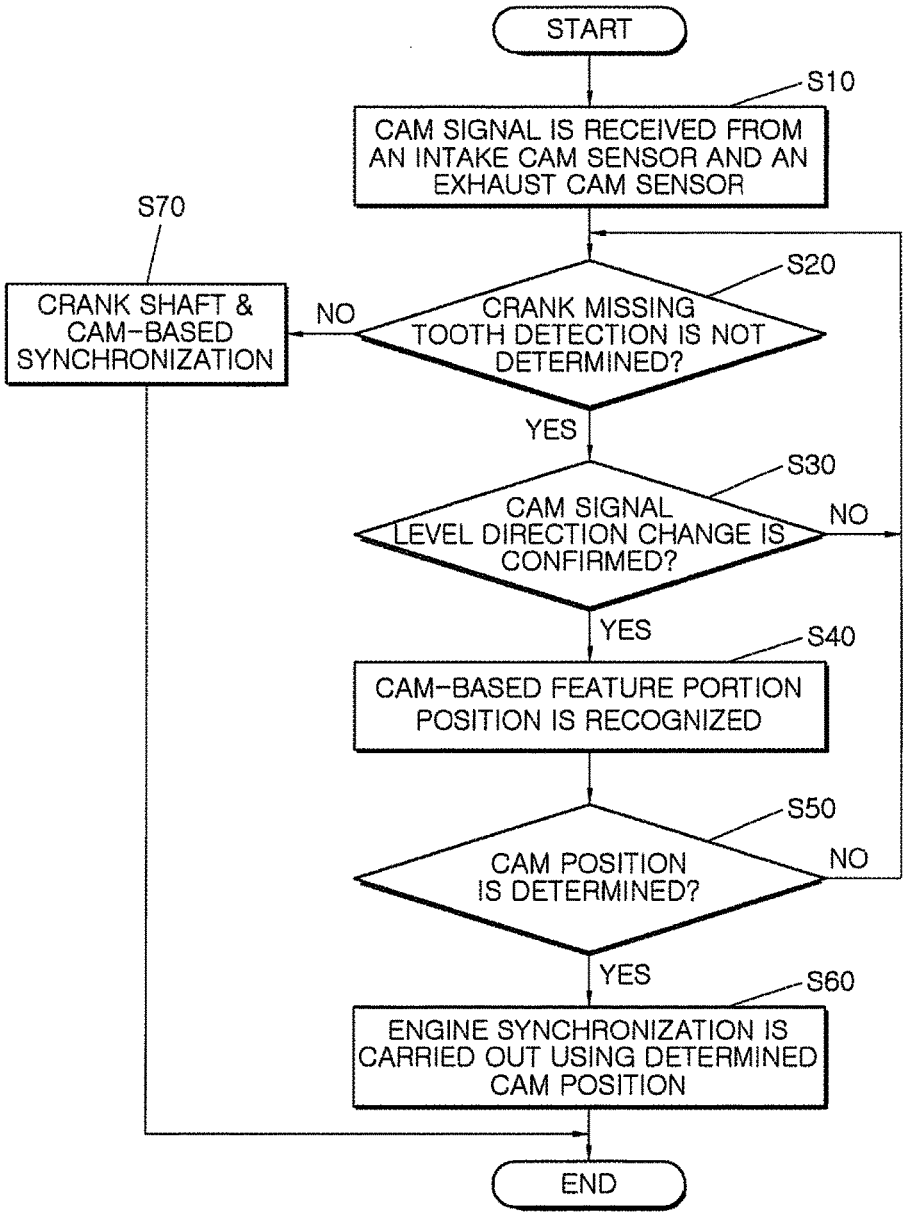
FIG. 2 is a flow chart for describing a control method of an engine synchronization apparatus according to the present disclosure.

The control method of the controller of the engine synchronization apparatus according to the present invention will be described in detail with reference to FIG. 2.

The controller 300 may receive a cam signal from each of the intake cam sensor and the exhaust cam sensor (S10). The cam sensor 100 may transmit to the controller 300 the cam signal the voltage waveform of which changes between the high level W) and the low level (L) based on the rotation of the cam 110.

Next, the controller 300 may judge whether or not the position of the missing tooth 230 has been detected from a crank signal from the crank shaft position sensor 200 (S20). As illustrated in FIG. 1, the missing tooth 230 may be formed in such a way that some teeth 220 are partially missing at a predetermined section on the outer circumference of the sensor wheel 210. The signal corresponding to the missing teeth will have a period of over 2 times as compared to the other portions, for which the presence of the missing tooth 230 can be detected. If it is judged that the position of the missing tooth 230 is not currently detected, the controller 300 will search for any unique part from the cam signal so as to carry out the engine synchronization by using only the cam signal.

The controller 300 may judge whether or not the direction of the level of the cam signal has changed (H→L or L→H) (S30). In the above-described occasion, the cam shape is recognized in such a way to confirm only the shift of the signal level and then confirm the level with the inverted value with respect to the previous level valve, without considering the direction (H→L, L→H) of the signal level. If there is a signal level shift, it may seem to be appropriate to change into the level (L) which is inverted from the previous level (H), errors may occur in the following situations.

If a signal level generates in a state where the previous level (H) is recognized, but it is not detected due to an error during the signal level shift, the level of the original cam shape will become (H) by simply inverting the level value, but the value of the signal level that the ECU is recognizing is (L). Since the original cam shape is different to the information that the ECU is currently recognizing, an engine synchronization error may occur.

Figure 5:
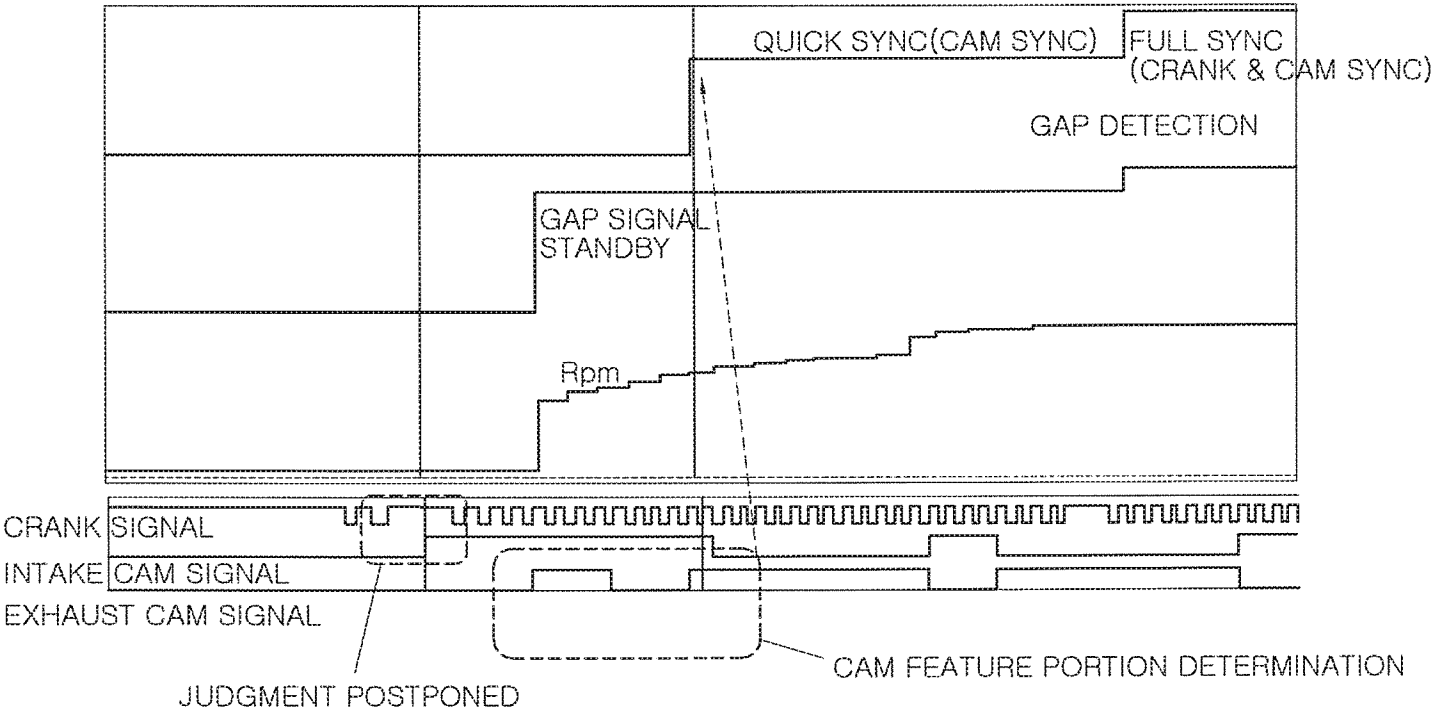
FIG. 5 is a view illustrating an example of the present disclosure wherein a quick sync is carried out using an exhaust cam when an error occurs at an intake cam according to the present disclosure.

As illustrated in FIG. 5, if the mounting time is supposed by the designer's intention to match with the tooth falling time before the missing area in case of the cam edge, an error may occur in the following situation. For this reason, in the present disclosure, the presence of any change on the direction is necessarily checked before the shift of the signal level.

Next, the controller 300 may roughly determine a cam position by analyzing the change pattern of the level of the cam signal and the level length thereof (S40). As described above, the information on the level distribution and the level length of the cam signal and the level of the cam signal at the time when the missing tooth of the crank signal is detected may have an innate value (a unique part) which is different based on the kinds and shapes of the cam when the crank shaft is at an appropriate rotation position. The crank position at a corresponding time therefore can be determined in such a way to compare the information on the level distribution and the level length of the measured cam signal to a previously stored characteristic value.

In case where it is possible to determine a unique part of the cam signal using only the information on the level, and the level length of the currently measured cam signal, the position of the unique part of the cam signal can be determined in such a way to compare, to a unique part of the previously stored cam signal, any sequential relationship between the information on the levels and the level lengths of the cam signals which were previously measured and accumulated, and the information on the level and the level length of the currently measured cam signal.

For example, in case of the control method of the engine synchronization according to the present disclosure, since the crank angle is determined using only the cam signal without detecting the position (a cam signal) of the missing tooth, an error may occur, wherein the positions of the unique parts of the cam signals having the same shape are two (one unique part including a gap signal and the other unique part not including a gap signal). In this case, the current crank angle and the cam position may be estimated in such a way to compare any sequential relationship between the position of the previously measured unique part and the level and the level length of the current cam signal to a previously stored value.

Next, in case where the crank angle and the cam position are supposed to be determined by detecting the voltage level and/or the level length, the controller 300 will carry out the synchronization control of the engine based on the same (S60). The controller 300 will carry out the synchronization control with respect to the fuel injection time and the ignition time of each cylinder in such a way to control the high pressure fuel pump 400, the injector 500, the ignition plug 600, etc. In case of the diesel engine, etc., the synchronization control can be carried out by controlling the fuel supply time and the ignition time.

In particular, the controller 300 according to the present disclosure may receive a cam signal from each of the exhaust cam sensor and the intake cam sensor, analyze the cam signals from both the cam sensors and utilize a result of the analysis for the sake of the engine synchronization with the aid of the cam signal from the cam wherein the position of the unique part of the cam signal has been first recognized. Even when the cam sensor of any of the intake cam and the exhaust cam has an error, the synchronization control can be quickly carried out by using the earn sensor of the other cam.

In the present disclosure, the engine synchronization will be carried out by selecting a cam signal of any of the exhaust cam and the intake cam based on the sequential relationship, for example, the time when the cam edge is detected or the time when the position of the cam can be determined, without utilizing only the cam signal of any of the exhaust cam and the intake cam.

In addition to the sensor error, the present disclosure may be employed to confirm the direction of the signal level to prevent any recognition error of the signal level for a quick start after the operation for clearing the signal level information during the installation and resolve any problem which may occur when engaging the mount within an allowable error range.

As illustrated in FIG. 5, the first gap signal related with the position of the missing tooth positions within the signal debounce section, this gap signal cannot be used for the engine synchronization. In this case, in the example as in FIG. 5, the unique part of the cam signal can be first determined at the exhaust cam rather than the intake cam. The quick sync (a cam sync) is carried out using the cam signal of the exhaust cam, and thereafter when the second gap signal is detected, the engine synchronization can be carried out by performing the full sync by using both the crank signal and the cam signal.

The controller 300 may carry out the control of the engine synchronization in such a way that when the position of the missing tooth 230 is determined by the crank shaft position sensor 200, the specific exhaust and intake cam levels are cross-checked at each point of the first and second missing tooth position determinations, thus determining the first and second specific missing tooth position determination time (S70).

FIG. 3 is a view illustrating a result of the use of the engine synchronization apparatus according to the present disclosure in case where the half-moon type cam is used.

As seen in FIG. 3, a corresponding signal is being ignored due to the signal debounce at the first missing tooth detection position in the crank signal, it cannot be used for the engine synchronization.

In case of the half-moon type cam, since the lengths of the voltage level of the cam signal are same for each pulse, the cam-based quick sync may be carried out by detecting any change in the voltage level. As seen in FIG. 3, in case of the exhaust cam signal, since the cam edge is earlier detected than the intake cam signal, and the determination of the unique part is available, the engine synchronization is carried out using the cam signal of the exhaust cam, and in case where the missing tooth is second detected, the full sync will be carried out using both the cam signal and the crank signal.

FIG. 4 is a view illustrating a result of the use of the engine synchronization apparatus according to the present disclosure in case where the 4-flank type cam is employed.

In case of the 4-flank type cam, different from the half-moon type, since the level lengths are different for each pulse, the position of the unique part of the cam signal can be detected using both the voltage level and the level length.

As illustrated in FIG. 4, according to the engine synchronization apparatus of the present disclosure, since the position of the unique part of the cam signal related with the cam shape is first determined from the intake cam, the quick sync (a cam sync) is first carried out based on the cam signal of the intake cam. Thereafter, in case where the gap signal related with the position of the missing tooth is detected, the full sync may be carried out by combining the crank signal and the cam signal.

The embodiments of the control method of an engine synchronization according to the present disclosure may be carried out assuming that the vehicle engine is a direct injection type gasoline engine. The control method according to the present disclosure is not limited to the vehicle which equips with the direct injection type gasoline engine. Such a control method may be employed to any kinds of the engines including the MPI (Multi-Point Injection) type engine or the diesel engine as long as the injection time and the ignition time can be controlled for the sake of the engine synchronization.

For example, the embodiments of the control method of the engine synchronization according to the present disclosure may be employed to the vehicle which equips with the diesel engine. In this case, the controller for the control of the engine synchronization may carry out the control of the engine synchronization with the aid of the control of the fuel supply time and the compression and ignition time.

While the present disclosure has been described with respect to the specific embodiments, it will be apparent to those skilled in the art that various changes and modifications may be made without departing from the spirit and scope of the invention as defined in the following claims.

What is claimed is:

1. An engine synchronization apparatus, comprising:

a crank shaft position sensor detecting a position of a crank shaft to detect a tooth and a missing tooth which are formed at the crank shaft;

a cam sensor, which includes an intake cam sensor and an exhaust cam sensor, detecting a position of a cam corresponding to an angle of rotation of each of an intake cam and an exhaust cam which operate in sync with an engine rotary shaft by detecting an edge of the cam; and a controller synchronizing the engine to use a tooth detection signal from the crank shaft position sensor and a cam signal from the cam sensor, wherein the controller carries out an engine synchronization by searching a unique part of the cam signal from a change pattern of a voltage level and a level length, which is a signal length while a same level is maintained, of the cam signal of the a cam selected among the intake cam and the exhaust cam, and by determining the position of the crank shaft and the position of the cam by comparing the unique part to a previously stored characteristic value of the cam.

2. The apparatus of claim 1, wherein the controller carries out the engine synchronization based on the cam signal of the cam wherein the position of the unique part of the cam signal between the intake cam and the exhaust cam is first determined.

3. The apparatus of claim 2, wherein the controller carries out the engine synchronization by using position information of a corresponding missing tooth when the detection of the missing tooth is determined by the crank shaft position sensor.

4. The apparatus of claim 2, wherein the controller determines whether or not the detected voltage level is valid to determine whether the voltage level of the cam signal is valid for a next level.

5. The apparatus of claim 1, wherein when the position of the unique part of the cam signal is not determined using only the voltage level and the level length which are measured by the cam sensor, the position of the unique part of the cam signal can be determined using a sequential relationship between a previously measured voltage level and level length and a currently measured voltage level and level length.

6. An engine synchronization method, wherein an engine synchronization is carried out using a crank shaft position sensor detecting a position of a crank shaft by detecting one or more teeth and a missing tooth which are installed at the crank shaft and a cam sensor, which comprises an intake cam sensor and an exhaust cam sensor, detecting a position of an edge of a cam corresponding to an angle of rotation of each of an intake cam and an exhaust cam which operate in sync with an engine rotary shaft, the method comprising:

receiving, by a controller, a cam signal from the cam sensor of each of the intake cam and the exhaust cam;

determining, by the controller, whether or not the missing tooth of the crank shaft is detected by the crank shaft position sensor;

searching, by the controller, a unique part of the cam signal from a change pattern of a voltage level and a level length, which is a signal length while a same level is maintained, of the cam signal of the cam selected among the intake cam and the exhaust cam, determining, by the controller, a cam position to compare the unique part to a previously stored position information of a unique part of the cam signal when the detection of the missing tooth of the crank shaft is not determined; and synchronizing, by the controller, the engine using the determined cam position information.

7. The method of claim 6, wherein the engine is synchronized based on a cam signal of the cam wherein the position of the unique part of the cam signal is first determined, among the earn signals received from the intake cam and the exhaust cam.

8. The method of claim 6, wherein the position information of a corresponding missing tooth is used when the detection of the missing tooth is determined by the crank shaft position sensor.

* * * * *